US008029429B2

(12) United States Patent
Tsai

(10) Patent No.: US 8,029,429 B2
(45) Date of Patent: Oct. 4, 2011

(54) MECHANISM AND METHOD FOR BONDING PAPER SHEETS ON INTERFOLDING MACHINE

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 129 days.

(21) Appl. No.: 12/071,609

(22) Filed: Feb. 25, 2008

(65) Prior Publication Data

US 2009/0137375 A1 May 28, 2009

(30) Foreign Application Priority Data

Nov. 27, 2007 (TW) ..... 96144921 A

(51) Int. Cl.
*B31B 1/56* (2006.01)

(52) U.S. Cl. ..... 493/402; 493/454; 493/397; 493/464; 493/401; 493/407; 493/416; 493/424; 493/435

(58) Field of Classification Search ..... 493/394–397, 493/400–403, 405–407, 416, 418, 422, 424, 493/425, 432–436, 442, 450, 454, 464
See application file for complete search history.

(56) References Cited

U.S. PATENT DOCUMENTS

| | | | | |
|---|---|---|---|---|
| 4,254,601 | A * | 3/1981 | Prager et al. | 53/133.8 |
| 4,582,555 | A * | 4/1986 | Bower | 156/290 |
| 4,693,058 | A * | 9/1987 | Kovacs | 53/552 |
| 4,765,604 | A * | 8/1988 | Trogan | 270/39.09 |
| 5,868,901 | A * | 2/1999 | Smith | 156/582 |
| 5,954,625 | A * | 9/1999 | Giesler, Sr. | 493/396 |
| 6,041,580 | A * | 3/2000 | Wojtech | 53/551 |
| 6,612,096 | B1 * | 9/2003 | Romijn | 53/374.2 |
| 6,736,182 | B2 * | 5/2004 | Smith et al. | 156/581 |
| 6,877,296 | B2 * | 4/2005 | Kohl et al. | 53/451 |
| 7,458,927 | B2 * | 12/2008 | Kauppila et al. | 493/435 |

* cited by examiner

*Primary Examiner* — Christopher Harmon
(74) *Attorney, Agent, or Firm* — Rosenberg, Klein & Lee

(57) ABSTRACT

In a mechanism and method for bonding two paper sheets on an interfolding machine, pre-compressing mechanisms are provided on each of two folding rollers to produce compress-to-bond areas on overlapped portions of two thick or air-impermeable paper sheets transferred to the two folding rollers, so that all plies of the two paper sheets at the compress-to-bond areas are compressed to bond together. Thereby, when the interfolding machine operates at a high speed, a plurality of the locally compressed and bonded paper sheets may still be smoothly folded to form a stack of interfolded paper sheets, such as a tissue paper stack or a paper towel stack.

4 Claims, 12 Drawing Sheets

MECHANISM AND METHOD FOR BONDING PAPER SHEETS ON INTERFOLDING MACHINE

FIELD OF THE INVENTION

The present invention relates to an interfolding machine, more particularly to a mechanism and method for pre-compressing and bonding paper sheets on an interfolding machine.

BACKGROUND OF THE INVENTION

In the process of interfolding and stacking relatively thick or air-impermeable one-ply or multi-ply paper sheets on an interfolding machine, the paper sheets to be interfolded are not always securely bonded together but may displace relative to one another. As a result, wrinkles, folds, and looseness frequently occur between two interfolded paper sheets or between the plies thereof, giving the interfolded paper sheets an unsmooth appearance.

A conventional way of solving the above problem is to perforate the paper sheets and form air vents thereon in order to increase the air permeability thereof, so that an enhanced suction is produced between two paper sheets or between the plies of the paper sheets, making them bonded together. For example, U.S. Pat. No. 6,213,927B1 discloses an interfolding method of sheet material not or not enough permeable to air and machine used to carry out such method. The interfolding machine has two folding rollers, which are provided on respective outer peripheral surfaces with a plurality of sucking spots; and two rollers separately located above the two folding rollers, and having a plurality of needles provided on the outer peripheral surfaces thereof corresponding to the sucking spots on the folding rollers, so as to perforate the sheet material not or not enough permeable to air at predetermined positions.

However, the perforations or air vents are useful only when they are formed within a particular narrow area on each paper sheet at where the paper sheet is folded. Moreover, the forming of perforations on the paper sheets tends to cause breaking and accordingly, poor quality of the paper sheets.

SUMMARY OF THE INVENTION

A primary object of the present invention is to provide a mechanism and method for locally pre-compressing overlapped paper sheets, so that a plurality of overlapped paper sheets may be bonded to one another before being interfolded.

Another object of the present invention is to provide an interfolding machine with mechanisms for locally pre-compressing overlapped paper sheets, so that the overlapped paper sheets are bonded together at overlapped portions without the need of perforating the paper sheets, and the problem of breaking paper sheets caused by the perforation can be avoided.

To achieve the above and other objects, the mechanism for bonding paper sheets on an interfolding machine according to the present invention includes two adjacent counter-rotating folding rollers with a pre-compressing space existed therebetween. The folding rollers are characterized by each folding roller being provided with a plural rows of first and second compressing mechanisms projected from an outer circumferential surface of the folding roller. The rows of first compressing mechanisms on the two adjacent folding rollers are circumferentially equally spaced. And, a sunken section is formed on each folding roller at a middle portion between any two adjacent rows of first compressing mechanisms. The rows of first compressing mechanisms on the two counter-rotating folding rollers are alternately moved to the pre-compressing space. When one row of first compressing mechanisms on one folding roller is moved to the pre-compressing space, one row of sunken sections on the other folding roller is also moved to the pre-compressing space at the same time. At the pre-compressing space, the row of first compressing mechanisms compresses a trailing edge of a paper sheet bearing thereon against another paper sheet bearing on the sunken sections on the other folding roller to thereby produce a transverse line of first compress-to-bond areas, at where the plies of the two paper sheets are compressed, making the two paper sheets bonded together.

The rows of second compressing mechanisms on the two folding rollers are separately located next to the same side of the rows of first compressing mechanisms. The rows of second compressing mechanisms on the two counter-rotating folding rollers are alternately moved to the pre-compressing space. When one row of second compressing mechanisms on one folding roller is moved to the pre-compressing space, one row of sunken sections on the other folding roller is also moved to the pre-compressing space at the same time. At the pre-compressing space, the row of second compressing mechanisms compresses a leading edge of a paper sheet bearing thereon against another paper sheet bearing on the sunken sections on the other folding roller to thereby produce a transverse line of second compress-to-bond areas, at where the plies of the two paper sheets are compressed, making the two paper sheets bonded together.

With the above arrangements, two paper sheets on the two counter-rotating folding rollers are locally pre-compressed to bond together at overlapped portions, allowing them to be smoothly folded to form a stack of interfolded paper sheets even when the interfolding machine operates at high speed. With the compressing mechanisms provided on the folding rollers, it is not necessary to perforate the paper sheets to form air vents, and the problem of breaking paper sheets due to such air vents is avoided.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
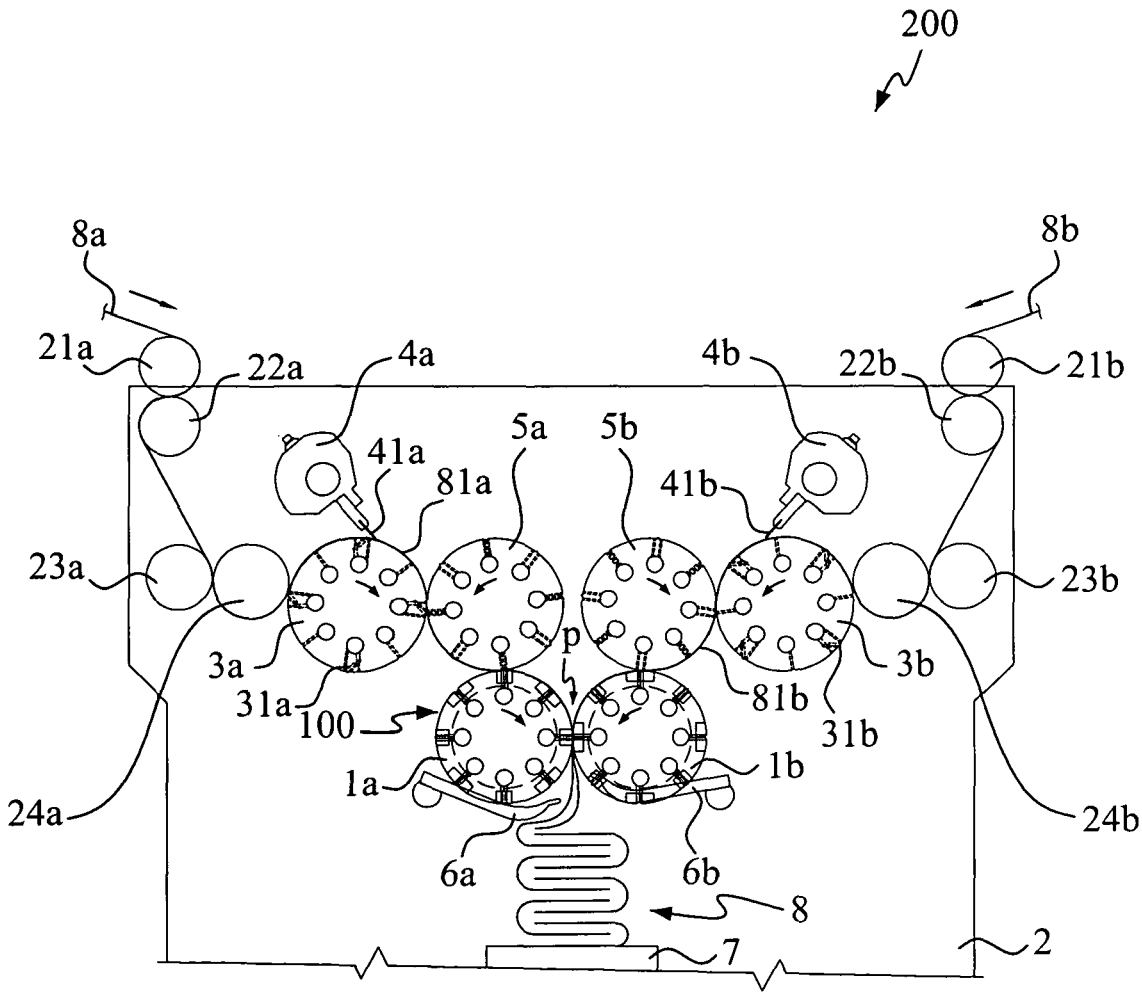
FIG. 1 is a side view of a mechanism for bonding paper sheets on interfolding machine according to a preferred embodiment of the present invention.

Please refer to FIG. 1. A mechanism for bonding paper sheets on an interfolding machine according to a preferred embodiment of the present invention is generally denoted a reference numeral 100, and is also briefly referred to as the mechanism 100 herein. As shown, the mechanism 100 is arranged in an interfolding machine 200 at a predetermined position thereof, and includes two adjacent counter-rotating folding rollers 1*a* and 1*b*. The folding roller 1*b* is located in the vicinity of the folding roller 1*a*, so that a pre-compressing space P exists between the two folding rollers 1*a*, 1*b*. The pre-compressing space P is the shortest distance between the outer circumferential surfaces of the two folding rollers 1*a* and 1*b*. The folding roller 1*b* is rotating along a direction reverse to that of the folding roller 1*a*.

The interfolding machine 200 includes a machine frame 2; a pair of first rollers 21*a*, 21*b*; a pair of second rollers 22*a*, 22*b*; a pair of third rollers 23*a*, 23*b*; a pair of fourth rollers 24*a*, 24*b*; a pair of bed knife rollers 3*a*, 3*b*; a pair of upper knife shafts 4*a*, 4*b*; a pair of transfer rollers 5*a*, 5*b*; a pair of folding rollers 1*a*, 1*b*; a pair of folding arms 6*a*, 6*b*; and a platform 7. The location and the number of the first, the second, the third, and the fourth rollers may be varied according to the size of the machine frame 2.

The bed knife rollers 3*a*, 3*b*, the upper knife shafts 4*a*, 4*b*, the transfer rollers 5*a*, 5*b*, and the folding rollers 1*a*, 1*b* are connected at respective roller shaft to the machine frame 2. The bed knife rollers 3*a*, 3*b* are provided along respective circumferential surface with a plurality of equally spaced cutting blades 31*a*, 31*b*. The upper knife shafts 4*a*, 4*b* are located near and above the bed knife rollers 3*a*, 3*b*, respectively, and include an upper blade 41*a*, 41*b* each. The transfer rollers 5*a*, 5*b* are located between and adjacent to the bed knife rollers 3*a*, 3*b*, respectively; and the folding rollers 1*a*, 1*b* are located below and adjacent to the transfer rollers 5*a*, 5*b*, respectively.

Two webs 8*a*, 8*b* having a predetermined width are separately fed through the first rollers 21*a*, 21*b*, the second rollers 22*a*, 22*b*, the third rollers 23*a*, 23*b*, and the fourth rollers 24*a*, 24*b* to the bed knife rollers 3*a*, 3*b*. The webs 8*a*, 8*b* may be a certain type of relatively thick paper, air-impermeable paper, or low-air-permeable paper; and may be one-ply or multi-ply, such as a two-ply paper. When the upper blades 41*a*, 41*b* on the upper knife shafts 4*a*, 4*b* are in contact with the cutting blades 31*a*, 31*b* on the bed knife rollers 3*a*, 3*b* while the bed knife rollers 3*a*, 3*b* rotate, the webs 8*a*, 8*b* are separately cut into a plurality of paper sheets 81*a*, 81*b* having a predetermined length.

The paper sheets 81*a*, 81*b* are separately transferred by the transfer rollers 5*a*, 5*b* to the folding rollers 1*a* and 1*b*. The rotating folding rollers 1*a*, 1*b* further transfer the paper sheets 81*a*, 81*b* to the pre-compressing space P between the two folding rollers 1*a*, 1*b*. At the pre-compressing space P, the paper sheets 81*a*, 81*b* are in contact with and overlap each other, and the folding rollers 1*a*, 1*b* alternately compress the paper sheets 81*a*, 81*b* at predetermined positions within the overlapped portions to produce transverse lines of compressed areas on the paper sheets 81*a*, 81*b*, so that the plies of the paper sheets 81*a*, 81*b* at the compressed areas become bonded together, and a folding line is formed between two lines of compressed areas. The areas on the paper sheets 81*a*, 81*b* having been compressed to bond the paper sheets or paper plies are referred to as the compress-to-bond areas herein. Then, the folding arms 6*a*, 6*b* alternately fold the paper sheets 81*a*, 81*b* sequentially passed through the pre-compressing space P, so that the paper sheets 81*a*, 81*b* are interfolded along the folding line and stacked on the platform 7 to form a stack of interfolded paper sheets 8, such as a stack of interfolded tissue papers or interfolded paper towels. The manner and process of producing the compress-to-bond areas on the paper sheets 81*a*, 81*b* will be described in more details later with reference to FIGS. 3 to 8.

The bed knife rollers 3*a*, 3*b*, the transfer rollers 5*a*, 5*b*, and the folding rollers 1*a*, 1*b* are connected separately to an independent sucking device or to a common sucking device (not shown), so that the paper sheets 81*a*, 81*b* may be sucked to or released from the outer circumferential surfaces of the bed knife rollers 3*a*, 3*b*, the transfer rollers 5*a*, 5*b*, and the folding rollers 1*a*, 1*b* via the control of these sucking devices.

The upper knife shafts 4*a*, 4*b* are separately connected to a pneumatic control device (not shown), so that the upper knife shafts 4*a*, 4*b* are controlled by extendable cylinder pistons of the pneumatic control devices to rotate. When the webs 8*a*, 8*b* are used up and new webs must be introduced into the interfolding machine 200, the pneumatic control devices may be actuated to rotate the upper knife shafts 4*a*, 4*b*, so as to increase the clearance between the upper blades 41*a*, 41*b* and the cutting blades 31*a*, 31*b* at the bed knife rollers 3*a*, 3*b*. After the new webs are introduced into the interfolding machine 200, the pneumatic control devices may be actuated again to rotate the upper knife shafts 4*a*, 4*b* to their initial position and resume the production of paper sheets.

Figure 2:
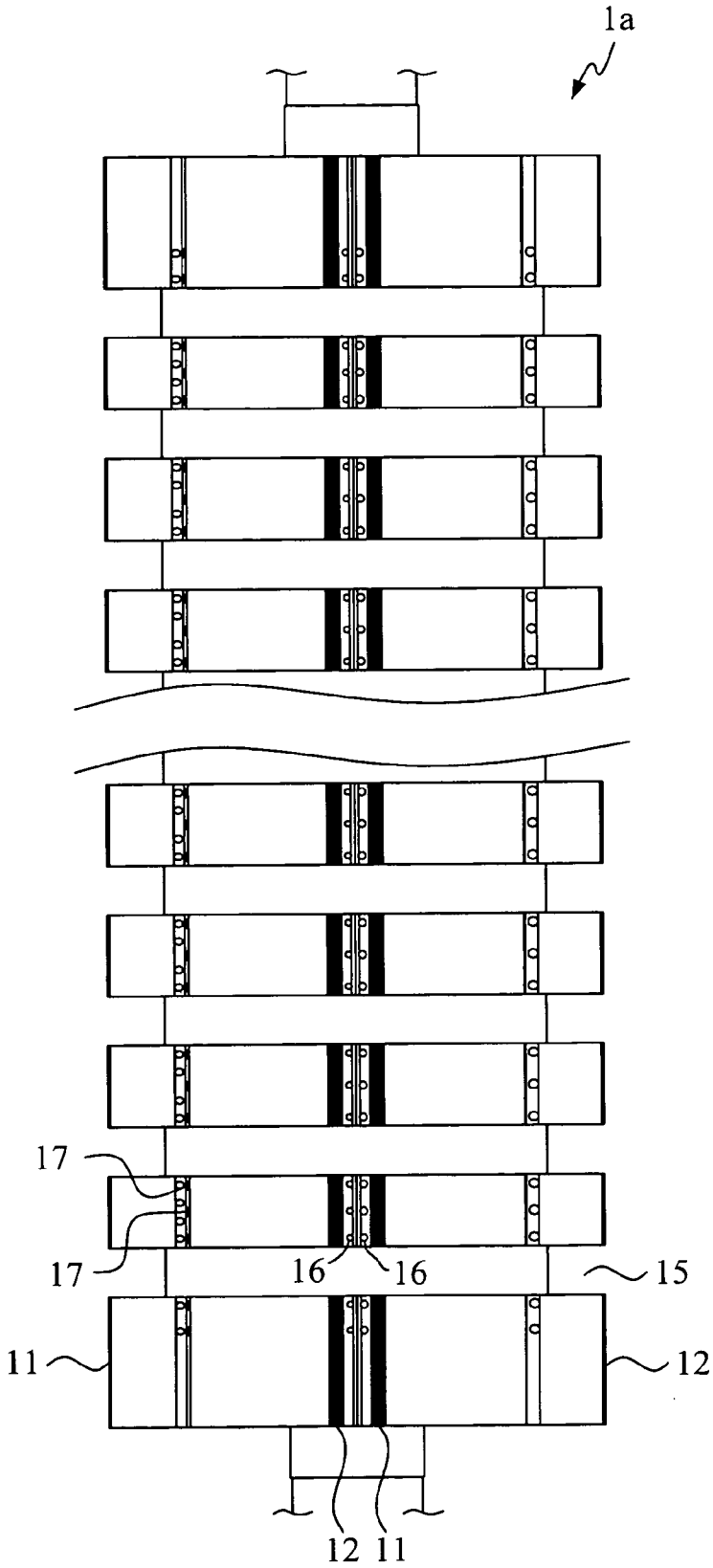
FIG. 2 is a fragmentary top view of a folding roller included in the present invention.
Figure 3:
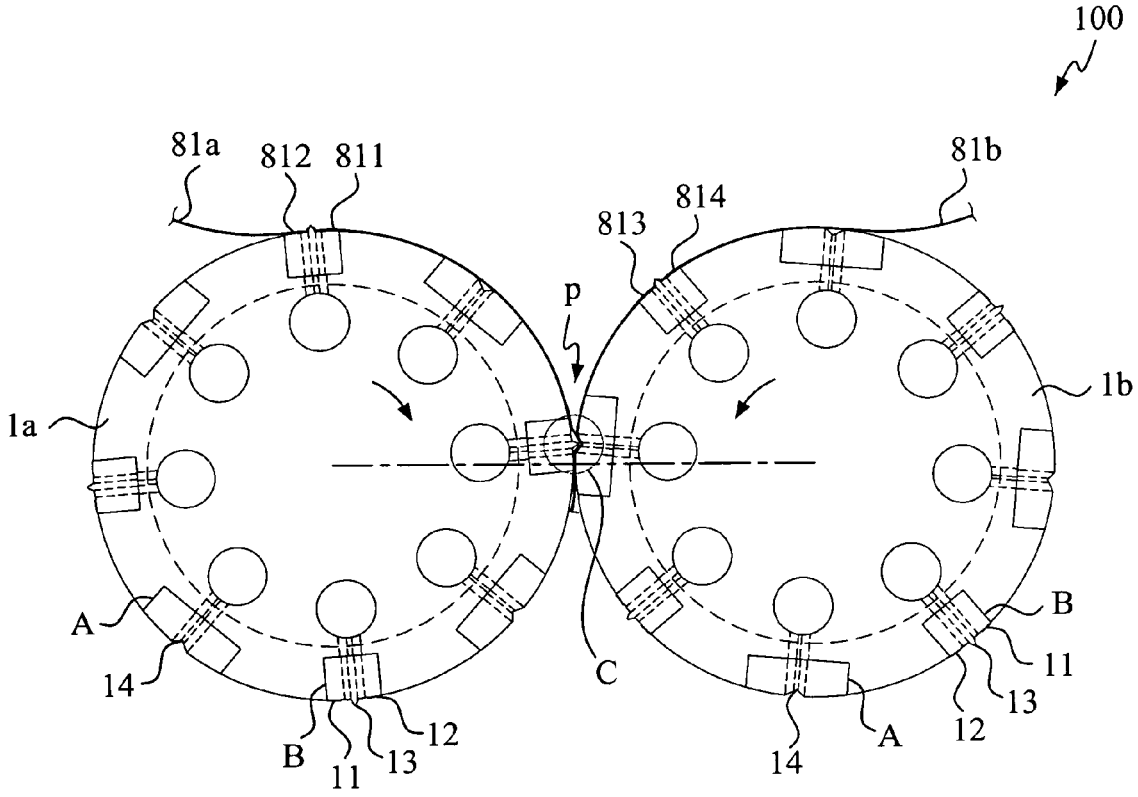
FIG. 3 shows that a first compressing mechanism on one folding roller is moved to a pre-compressing space between the folding roller and another folding roller.
Figure 4:
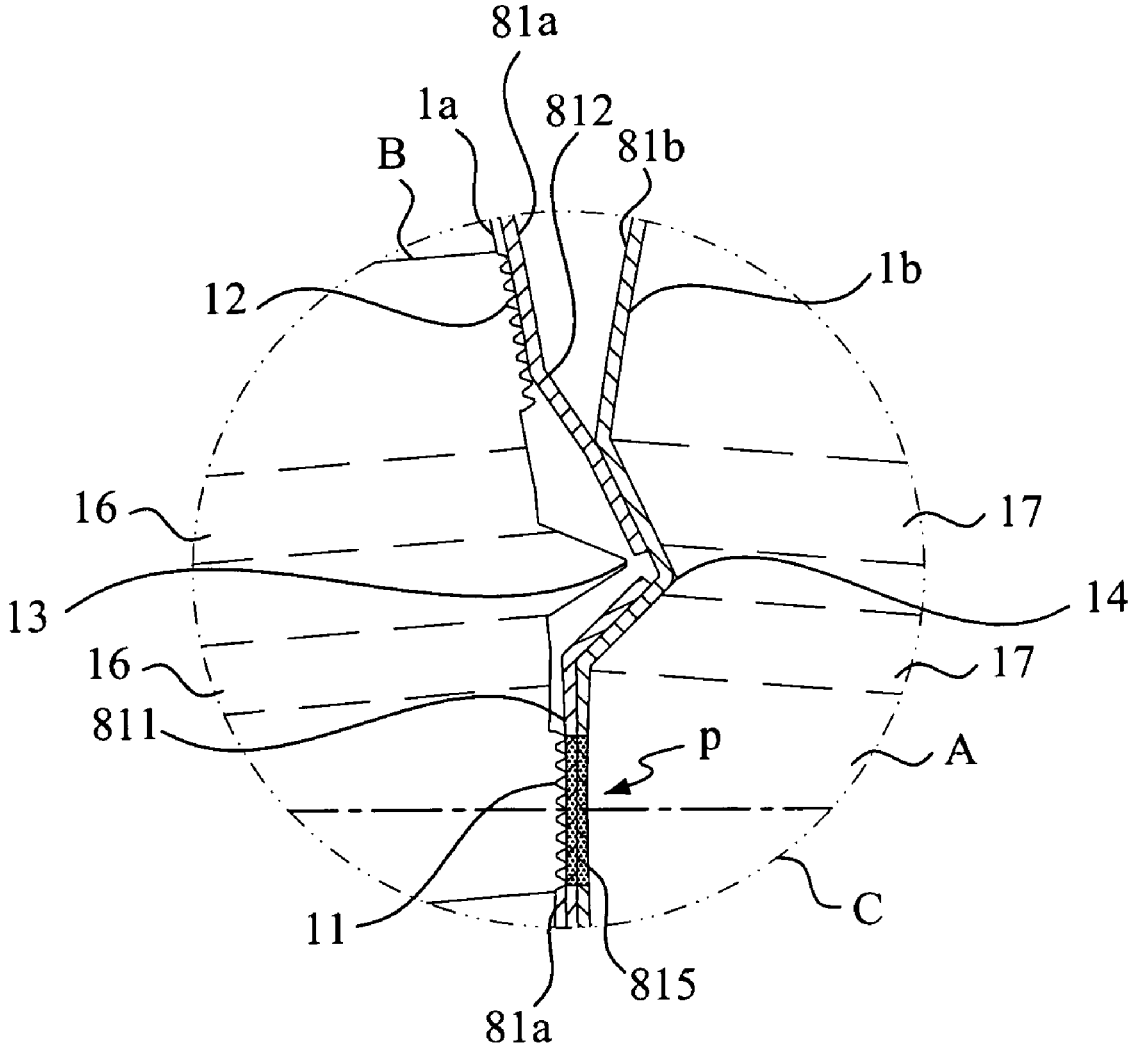
FIG. 4 is an enlarged view of the circled area C in FIG. 3.

Please refer to FIGS. 2 to 4. The folding rollers 1*a*, 1*b* are provided on respective circumferential surface with a plurality of circumferentially equally spaced rows of radially projected first compressing mechanisms 11. A sunken section A is defined at a middle area between any two adjacent rows of first compressing mechanisms 11. The sunken sections A at the folding rollers 1*a*, 1*b* are provided at respective middle portion with an anvil recess 14 each.

The folding rollers 1*a*, 1*b* are also provided on respective circumferential surface with a plurality of rows of radially projected second compressing mechanisms 12, which are separately located near and at the same side of each row of the first compressing mechanisms 11, and therefore have the same number as that of the rows of first compressing mechanisms 11.

A wedge-shaped protrusion 13 is formed between any two adjacent rows of first and second compressing mechanisms 11, 12. Each area with one row of first compressing mechanisms 11, one adjacent row of second compressing mechanisms 12, and the middle wedge-shaped protrusion 13 provided thereat is defined as a projected section B at the folding rollers 1*a*, 1*b*.

The folding rollers 1*a*, 1*b* are also provided around respective circumferential surface with a plurality of axially spaced annular grooves 15, so that all the rows of first compressing mechanisms 11, the rows of second compressing mechanisms 12, the wedge-shaped protrusions 13, and the anvil recesses 14 are divided by the annular grooves 15 into several segments.

The rows of first compressing mechanisms 11 on the two folding rollers 1*a*, 1*b* are alternately moved to the pre-compressing space P when the folding rollers 1*a*, 1*b* rotate. More specifically, when one row of first compressing mechanisms 11 on one of the two folding rollers, say the folding roller 1*a*, is moved to the pre-compressing space P, one row of sunken sections A on the other folding roller 1*b* is moved to the pre-compressing space P at the same time.

The folding rollers 1*a*, 1*b* are provided at two lateral sides of each of the wedge-shaped protrusions 13 with at least one first sucking channel 16 each. In the illustrated side views, only one first sucking channel 16 can be seen at each lateral side of the wedge-shaped protrusions 13. Similarly, the folding rollers 1*a*, 1*b* are provided at each of the anvil recesses 14 with at least one second sucking channel 17. In the illustrated side views, one second sucking channel 17 can be seen at each lateral side of the anvil recess 14. An operator or designer may control to suck or to stop sucking air from the first sucking channels 16 and the second sucking channels 17, so that the paper sheets 81*a*, 81*b* transferred to the folding rollers 1*a*, 1*b* may be orderly sucked to or released from the circumferential surfaces of the folding rollers 1*a*, 1*b*, respectively.

Each of the paper sheets 81*a* transferred to and received by the folding roller 1*a* has a trailing edge 811 and a leading edge 812. Similarly, each of the paper sheets 81*b* transferred to and received by the folding roller 1*b* has a trailing edge 813 and a leading edge 814. Each paper sheet 81*a* received by the folding roller 1*a* has the trailing edge 811 thereof bearing on one row of first compressing mechanisms 11 on the folding roller 1*a*, and a middle portion thereof bearing on one row of sunken sections A. Similarly, each paper sheet 81*b* received by the folding roller 1*b* has the trailing edge 813 thereof bearing on one row of first compressing mechanisms 11 on the folding roller 1*b*, and a middle portion thereof bearing on one row of sunken sections A.

When the trailing edge 811 of the paper sheet 81*a* on the rotating folding roller 1*a* is moved to the pre-compressing space P, the row of first compressing mechanisms 11 with the trailing edge 811 of the paper sheet 81*a* bearing thereon automatically compresses the trailing edge 811 against the paper sheet 81*b* bearing on the sunken sections A of the folding roller 1*b* also moved to the pre-compressing space P, so as to produce a transverse line of first compress-to-bond areas 815, at where the trailing edge 811 of the paper sheet 81*a* on the folding roller 1*a* and the middle portion of the paper sheet 81*b* on the folding roller 1*b* are compressed to bond together. Similarly, when the trailing edge 813 of the paper sheet 81*b* on the rotating folding roller 1*b* is moved to the pre-compressing space P, the row of first compressing mechanisms 11 with the trailing edge 813 of the paper sheet 81*b* bearing thereon automatically compresses the trailing edge 813 against the paper sheet 81*a* bearing on the sunken sections A of the folding roller 1*a* also moved to the pre-compressing space P, so as to produce a transverse line of first compress-to-bond areas 815, at where the trailing edge 813 of the paper sheet 81*b* on the folding roller 1*b* and the middle portion of the paper sheet 81*a* on the folding roller 1*a* are compressed to bond together.

Figure 5:
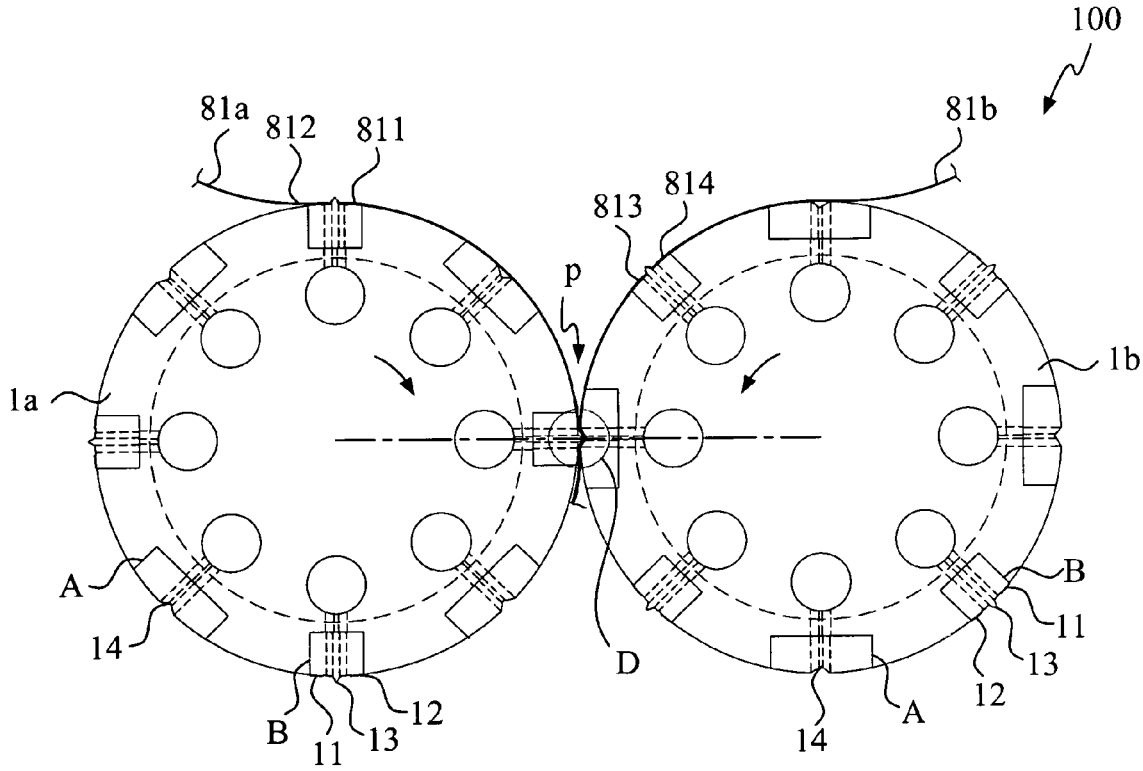
FIG. 5 shows that a wedge-shaped protrusion on one folding roller is moved to the pre-compressing space between the two folding rollers.
Figure 6:
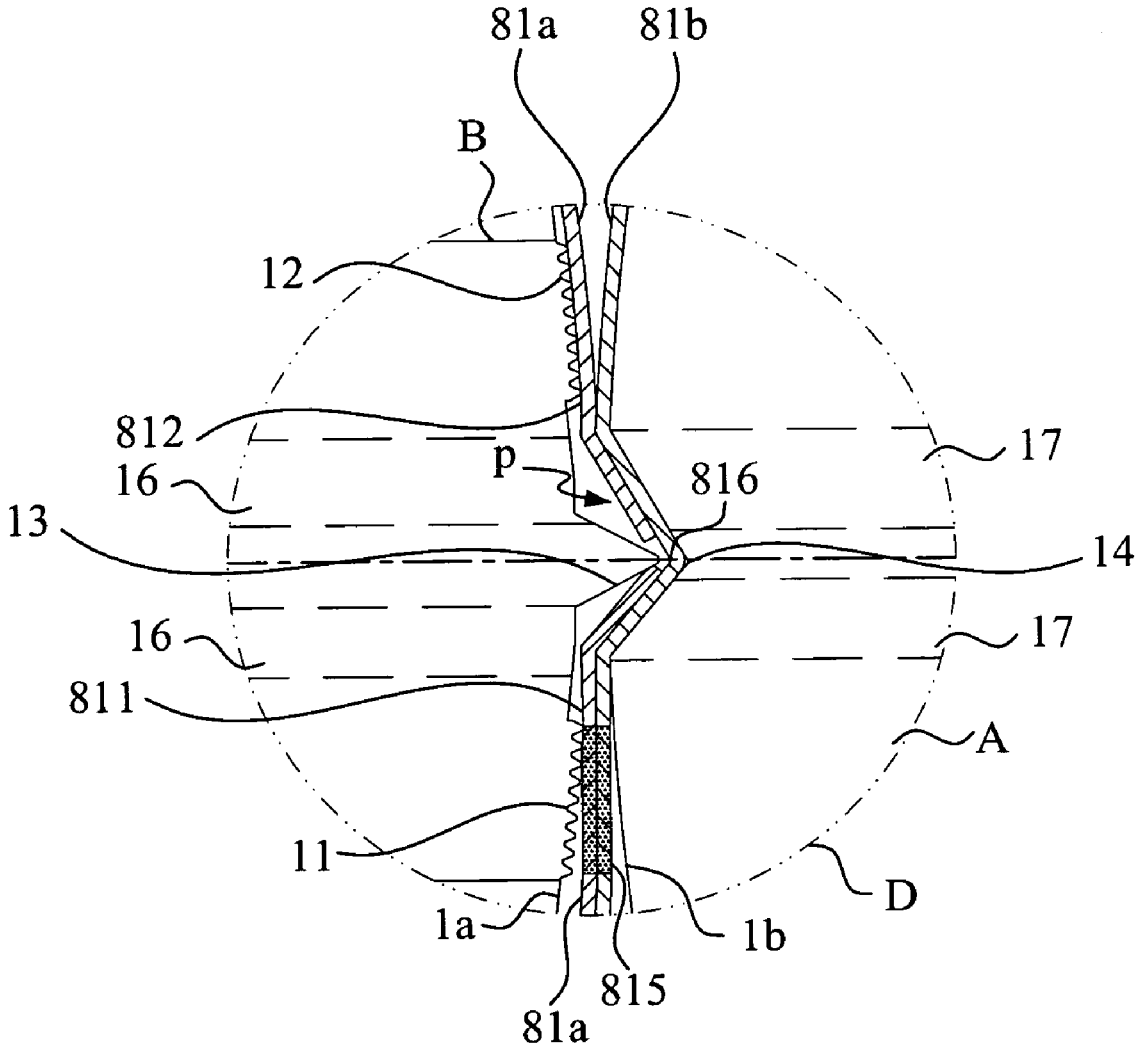
FIG. 6 is an enlarged view of the circled area D in FIG. 5.

Please refer to FIGS. 5 and 6. When one of the wedge-shaped protrusions 13 on the rotating folding roller 1*a* is moved to the pre-compressing space P, the wedge-shaped protrusion 13 is just fitted in one anvil recess 14 at the folding roller 1*b* also moved to the pre-compressing space P. With suction force produced via the second sucking channels 17 at the anvil recess 14 of the folding roller 1*b*, as well as the action of the wedge-shaped protrusion 13 on the folding roller 1*a*, a folding line 816 is produced on the paper sheet 81*b* bearing on the anvil recess 14 of the folding roller 1*b*. Similarly, when one of the wedge-shaped protrusions 13 on the rotating folding roller 1*b* is moved to the pre-compressing space P, the wedge-shaped protrusion 13 is just fitted in one anvil recess 14 at the folding roller 1*a* also moved to the pre-compressing space P. With the suction force produced via the second sucking channels 17 at the anvil recess 14 on the folding roller 1*a*, as well as the action of the wedge-shaped protrusion 13 on the folding roller 1*b*, a folding line 816 is produced on the paper sheet 81*a* bearing on the anvil recess 14 of the folding roller 1*a*.

Figure 7:
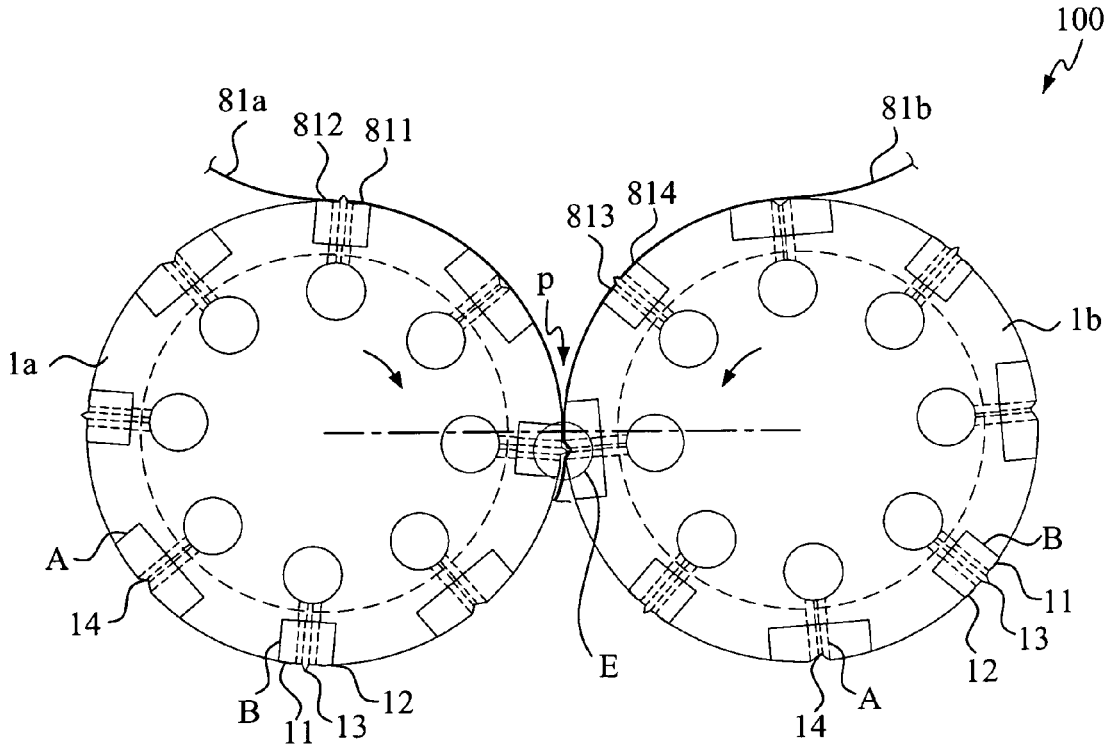
FIG. 7 shows that a second compressing mechanism on one folding roller is moved to the pre-compressing space between the two folding rollers.
Figure 8:
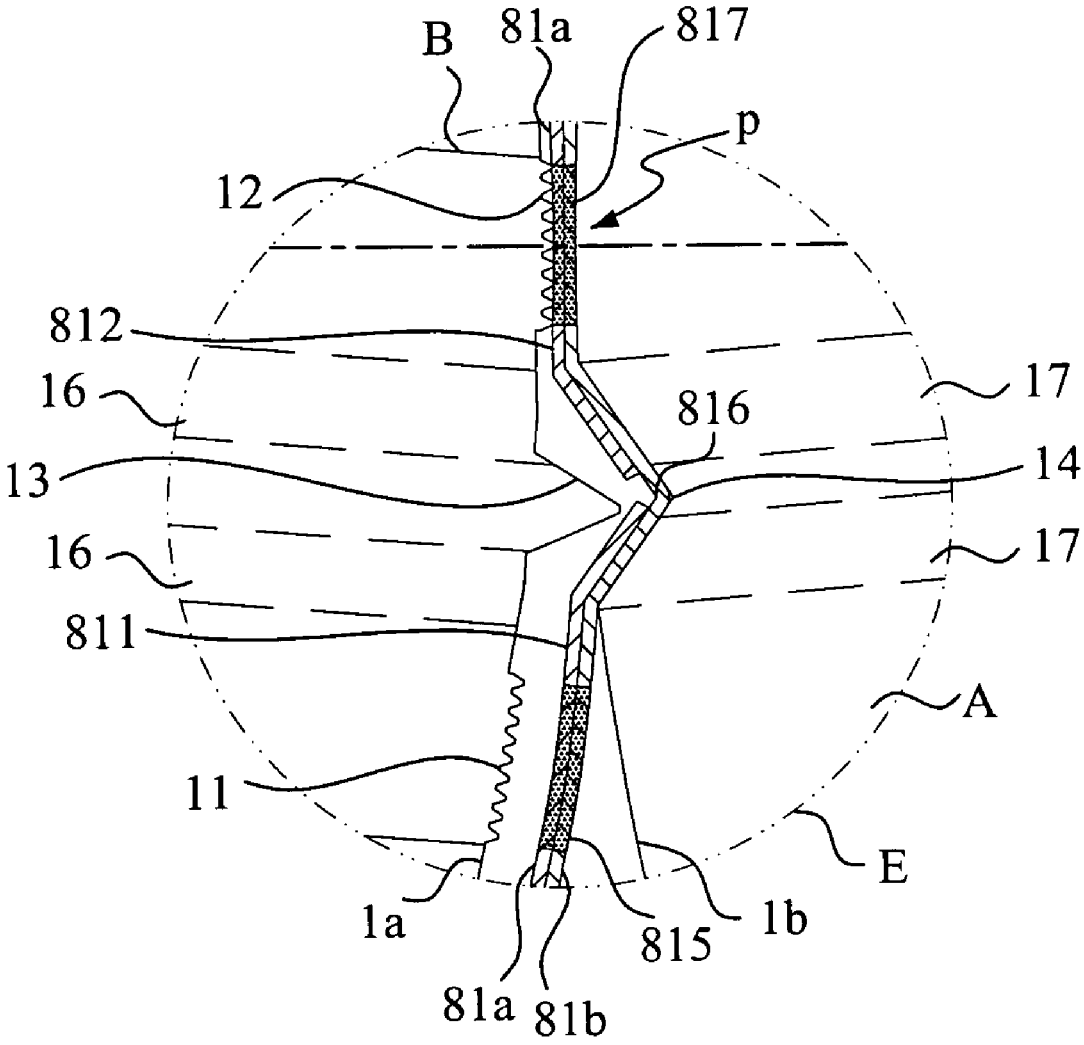
FIG. 8 is an enlarged view of the circled area E in FIG. 7.

Please refer to FIGS. 7 and 8. The rows of second compressing mechanisms 12 on the rotating folding rollers 1*a*, 1*b* are also alternately moved to the pre-compressing space P. When one row of second compressing mechanisms 12 on one of the two folding rollers, say the folding roller 1*a*, is moved to the pre-compressing space P, one row of sunken sections A on the other folding roller 1*b* is also moved to the pre-compressing space P.

When the leading edge 812 of the paper sheet 81*a* on the rotating folding roller 1*a* is moved to the pre-compressing space P, the row of second compressing mechanisms 12 with the leading edge 812 of the paper sheet 81*a* bearing thereon automatically compresses the leading edge 812 against the paper sheet 81*b* bearing on the sunken sections A of the folding roller 1*b* also moved to the pre-compressing space P, so as to produce a transverse line of second compress-to-bond areas 817, at where the leading edge 812 of the paper sheet 81*a* on the folding roller 1*a* and the middle portion of the paper sheet 81*b* on the folding roller 1*b* are compressed to bond together.

When the projected section B on the rotating folding roller 1*a* is moved to a position close to the pre-compressing space P, the first sucking channels 16 at the projected section B stop sucking, while the second sucking channels 17 at the sunken sections A on the folding roller 1*b* keep sucking to produce a suction force by sucking pumps (not shown) connected thereto, so that the paper sheet 81*b* is sucked to the sunken sections A on the folding roller 1*b* and the paper sheet 81*a* is also bonded to the paper sheet 81*b*.

Similarly, when the leading edge 814 of the paper sheet 81*b* on the rotating folding roller 1*b* is moved to the pre-compressing space P, the row of second compressing mechanisms 12 with the leading edge 814 of the paper sheet 81*b* bearing thereon automatically compresses the leading edge 814 against the paper sheet 81*a* bearing on the sunken sections A of the folding roller 1*a* also moved to the pre-compressing space P, so as to produce a transverse line of second compress-to-bond areas 817, at where the leading edge 814 of the paper sheet 81*b* on the folding roller 1*b* and the middle portion of the paper sheet 81*a* on the folding roller 1*a* are compressed to bond together.

When the line of first compress-to-bond areas 815 and the line of second compress-to-bond areas 817 are produced in the above-described manner, the paper sheets 81*a*, 81*b* are locally compressed together. That is, the overlapped paper sheets 81*a*, 81*b* are bonded together at the two lines of first and second compress-to-bond areas 815, 817 during the whole process of subsequent interfolding, ensuring the interfolding machine 200 to produce smoothly interfolded paper sheets even when the interfolding machine 200 works at a relatively high operating speed.

FIG. 8 shows the leading edge 812 of one paper sheet 81*a* and the trailing edge 811 of another paper sheet 81*a* are separately closely located upstream and downstream of the folding line 816 on the paper sheet 81*b* overlapping with the two paper sheets 81*a*. When the paper sheet 81*a*, 81*b* are separately transferred to the pre-compressing space P, they are staggered and overlapped.

Figure 9:
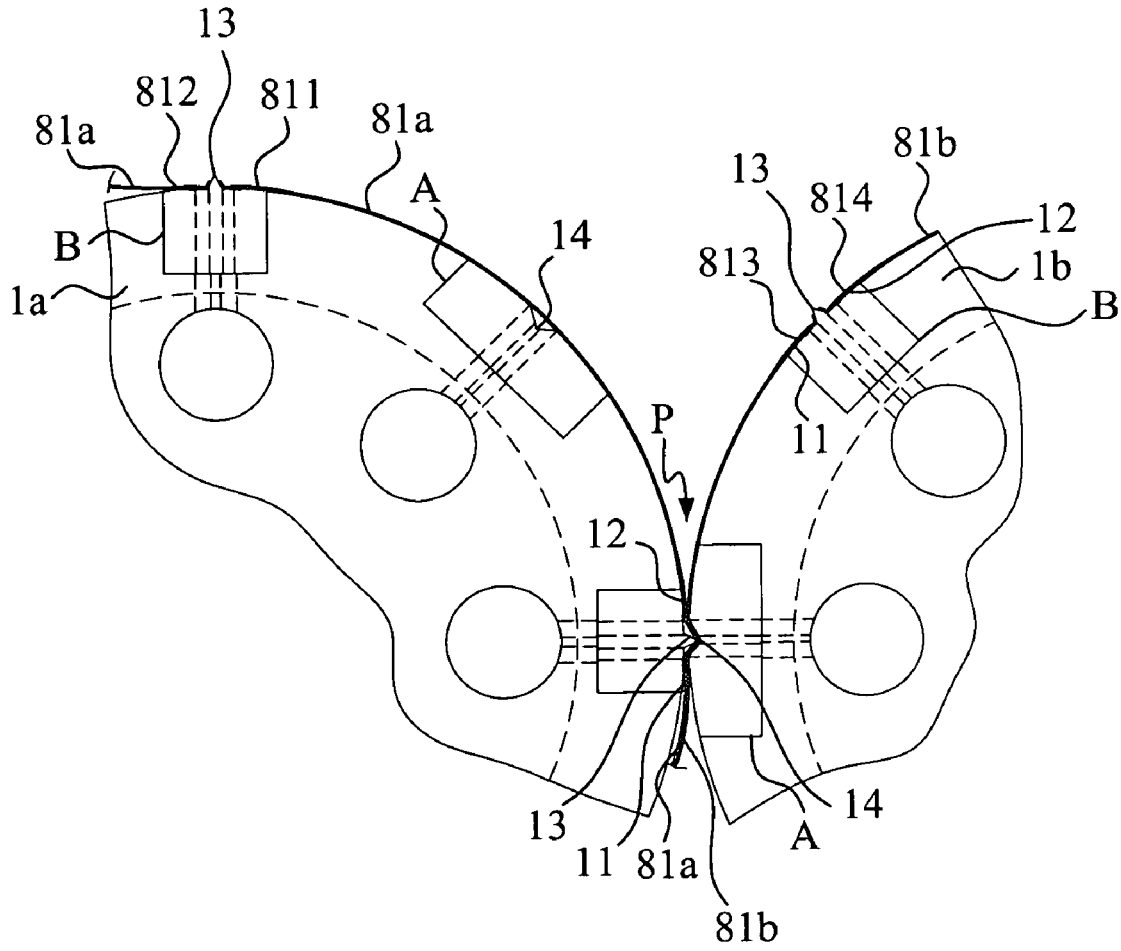
FIG. 9 is an enlarged fragmentary view showing the folding rollers and paper sheets bearing thereon.

Please refer to FIG. 9. The leading edge 812 of a following paper sheet 81*a* is closely located upstream of one wedge-shaped protrusion 13 on the rotating folding roller 1*a*, and the trailing edge 811 of a preceding paper sheet 81*a* is closely located downstream of the wedge-shaped protrusion 13. Similarly, the leading edge 814 of a following paper sheet 81*b* is closely located upstream of one wedge-shaped protrusion 13 on the rotating folding roller 1*b*, and the trailing edge 813 of a preceding paper sheet 81*b* is closely located downstream of the wedge-shaped protrusion 13. The paper sheets 81*a*, 81*b* on the two folding rollers 1*a*, 1*b* are arranged in such a staggered and overlapped relation and alternately transferred to the pre-compressing space P.

Figure 10:
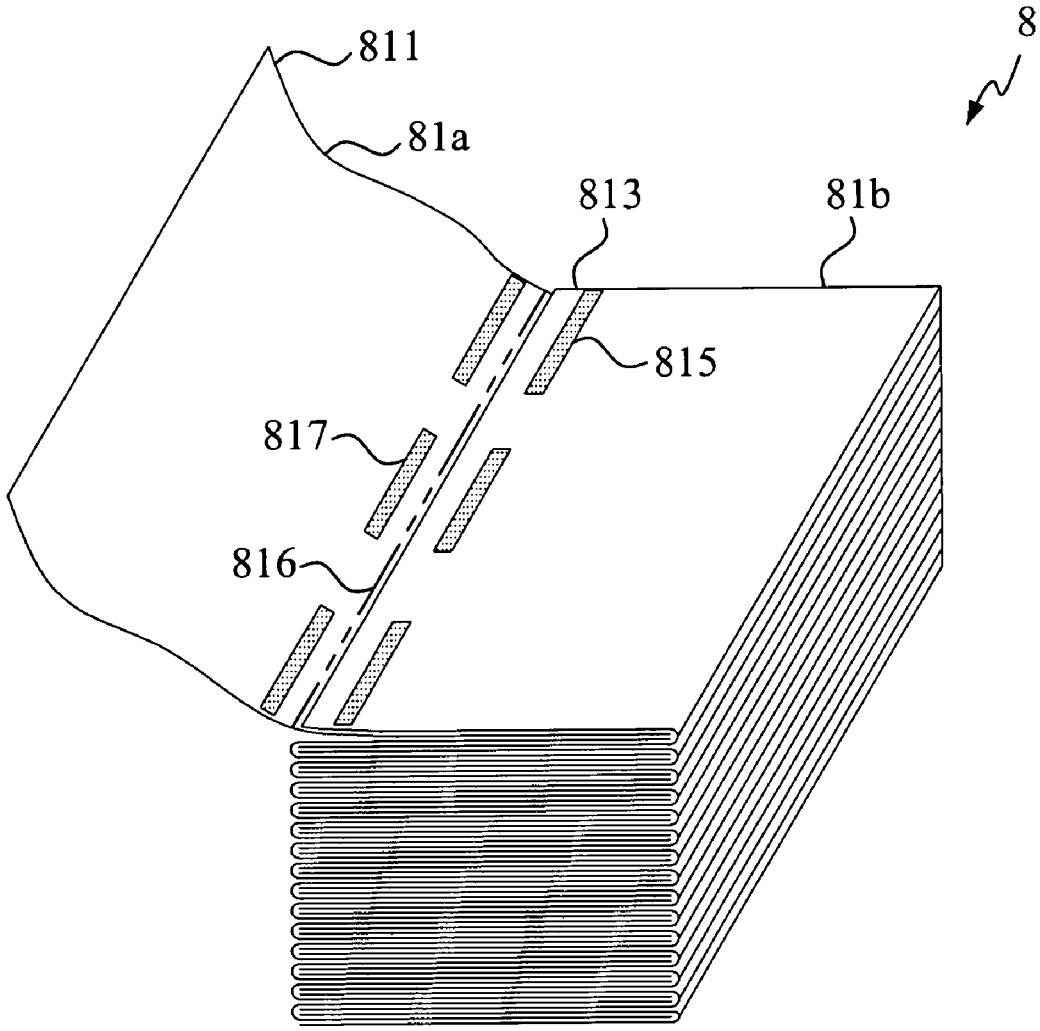
FIG. 10 shows a plurality of compress-to-bond areas are produced on a stack of interfolded paper sheets using the mechanism and method of the present invention.

Please refer to FIG. 10, there is shown a stack of interfolded paper sheets 8 produced by interfolding a plurality of the paper sheets 81*a*, 81*b* with the interfolding machine 200. Both of the paper sheets 81*a*, 81*b* have lines of first compress-to-bond areas 815 produced by the rows of first compressing mechanisms 11, a folding line 816 produced by the suction force at the second sucking channels 17, and lines of second compress-to-bond areas 817 produced by the rows of second compressing mechanisms 12. With the plurality of annular grooves 15 spaced on the folding rollers 1*a*, 1*b*, the rows of first and second compressing mechanisms 11, 12 are divided by the annular grooves 15 into several spaced segments. Therefore, the lines of first and second compress-to-bond areas 815, 817 produced on the paper sheets 81*a*, 81*b* by the segmented rows of first and second compressing mechanisms 11, 12, respectively, are also in the form of several spaced segments. In a subsequent processing, the stack of interfolded paper sheets is transversely cut into a number of stacks with a predetermined width. The paper sheets of each stack of the finished product comprise at least one segment of each first and second compress-to-bond areas 815, 817. In the illustrated preferred embodiment of the present invention, each row of the first and the second compressing mechanisms 11, 12 produces a line of three-segment first and second compress-to-bond areas 815, 817, respectively.

The number of the annular grooves 15 on the circumferential surfaces of the folding rollers 1*a*, 1*b* and the spacing between two adjacent annular grooves 15 may be decided by the designer or the manufacturer, so that the number of segments included in each line of the first and the second compress-to-bond areas 815, 817 produced by the rows of first and second compressing mechanisms 11, 12 is variable, and the length of each segment is not particularly limited. Moreover, in addition to the rows of first and second compressing mechanisms 11, 12, the folding rollers 1*a*, 1*b* may also be provided on respective circumferential surface at predetermined positions with other compressing mechanisms, so as to produce additional compress-to-bond areas on the paper sheets 81*a*, 81*b*. More specifically, additional compressing mechanisms may be provided on the folding rollers 1*a*, 1*b* to produce more lines of compress-to-bond areas within the overlapped portions of the paper sheets 81*a*, 81*b* for the plies of the overlapped paper sheets 81*a*, 81*b* to be exactly bonded together at these compress-to-bond areas.

Figure 11:
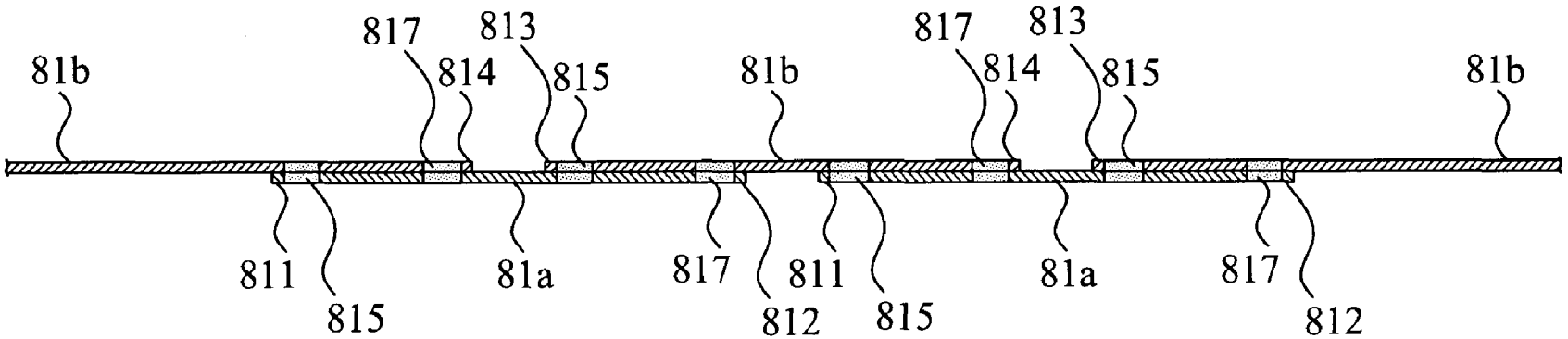
FIG. 11 is a developed sectional view of the interfolded paper sheets of FIG. 10.

FIG. 11 is a developed sectional view of the staggered and overlapped paper sheets 81*a*, 81*b*. As shown, the leading edge 812 of a following paper sheet 81*a* and the trailing edge 811 of a preceding paper sheet 81*a* are closely located upstream and downstream of a middle portion of a paper sheet 81*b* overlapping the two paper sheets 81*a*. And, the leading edge 814 of a following paper sheet 81*b* and the trailing edge 813 of a preceding paper sheet 81*b* are closely located upstream and downstream of a middle portion of a paper sheet 81*a* overlapping the two paper sheets 81*b*.

Figure 12:
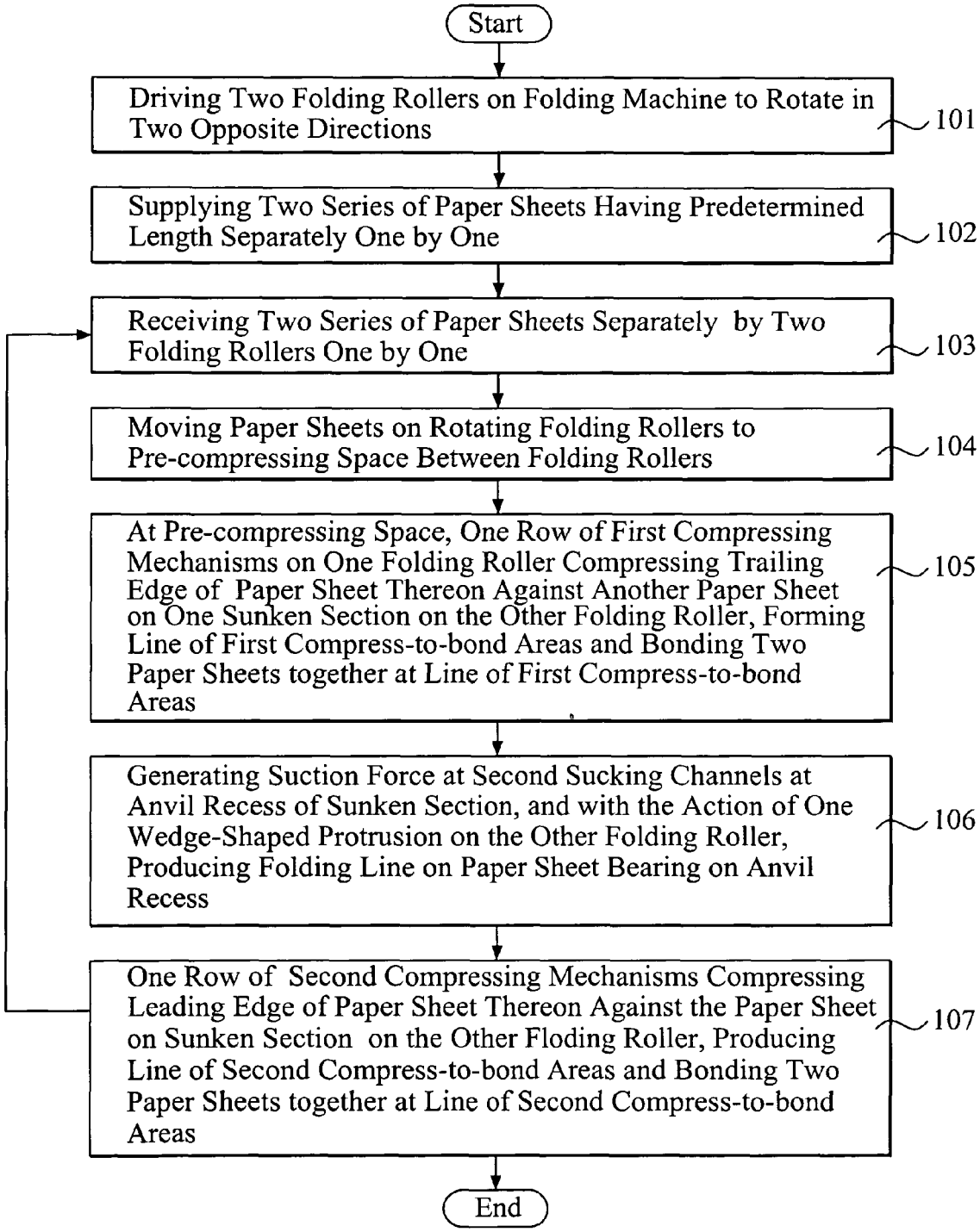
FIG. 12 is a flowchart showing the steps included in a method of bonding paper sheets on interfolding machine according to the present invention.

FIG. 12 is a flowchart showing the steps included in a method of bonding paper sheets on an interfolding machine according to the present invention. Please refer to FIG. 12 along with FIGS. 1 to 11. To bond two overlapped paper sheets together for subsequent smooth interfolding process on an interfolding machine, first the two folding rollers on the interfolding machine are driven to rotate in two opposite directions (step 101). In this manner, the plural rows of first compressing mechanisms provided on the two rotating folding rollers are alternately moved to the pre-compressing space existed between the two folding rollers, so that one row of first compressing mechanisms on one of the two folding rollers and one row of sunken sections on the other folding roller are synchronously moved to the pre-compressing space; and the plural rows of second compressing mechanisms provided on the two rotating folding rollers are also alternately moved to the pre-compressing space, so that one row of second compressing mechanisms on one of the two folding rollers and one row of sunken sections on the other folding roller are synchronously moved to the pre-compressing space.

Then, two series of paper sheets having a predetermined length are separately and sequentially supplied one by one (step 102). The two series of paper sheets with a predetermined length are produced by cutting two webs with the cutting blades on the pair of bed knife rollers and the upper blades on the pair of upper knife shafts. The produced paper sheets are then sequentially transferred to the two folding rollers one by one. Each of the paper sheets has a trailing edge and a leading edge.

The two series of paper sheets so produced are then separately received by the two folding rollers one by one (step 103). Each of the paper sheets is bearing on the folding roller with the trailing edge and the leading edge respectively located at one row of first compressing mechanisms and one adjacent row of second compressing mechanisms, and a middle portion of the paper sheet located at the anvil recess on one row of sunken sections.

The paper sheets bearing on the two rotating folding rollers are sequentially moved to the pre-compressing space one by one (step 104).

At the pre-compressing space, the row of first compressing mechanisms compresses the trailing edge of the paper sheet on one of the folding rollers against the paper sheet at the sunken sections on the other folding roller, so that a line of first compress-to-bond areas is produced, and the two paper sheets are bonded together at the line of first compress-to-bond areas (step 105).

At the pre-compressing space, a suction force is produced at the second sucking channels provided at the anvil recess on one of the folding rollers, and the suction force cooperates with the action of one wedge-shaped protrusion on the other folding roller to produce a folding line on the paper sheet that is bearing on the anvil recess (step 106).

At the pre-compressing space, the row of second compressing mechanisms compresses the leading edge of the paper sheet on one of the folding rollers against the paper sheet at the sunken sections on the other folding roller, so that a line of second compress-to-bond areas is produced, and the two paper sheets are bonded together at the line of second compress-to-bond areas (step 107).

Then, repeat step 103 to step 107 by predetermined times to form a stack of interfolded paper sheets, such as an interfolded tissue paper stack or an interfolded paper towel stack.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A mechanism for bonding paper sheets on an interfolding machine, comprising:

a first and second counter-rotating folding roller, each said counter-rotating folding roller adjacently displaced from the other to define a pre-compressing space therebetween operable to compress-to-bond at least two overlapping paper sheets together;

a plurality of projected sections including:

a first and second compressing mechanism each compressing mechanism including a plurality of adjacent ridge-like protrusions adapted to compress-to-bond two paper sheets together;

a wedge-shaped protrusion, wherein the projected sections formed on the outer circumferential surface of the first and second counter-rotating folding rollers, each wedge-shaped protrusion disposed circumferentially between the first compressing mechanism and the second compressing mechanism on a projected section;

a plurality of sunken sections, each having an anvil recess and being formed on the outer circumferential surface of the first and second counter-rotating folding rollers, and said sunken sections being interleaved with said projected sections;

whereby the pre-compressing space is further defined by counter rotating the first and second counter-rotating folding rollers to alternately mate the first compressing mechanism of the first counter-rotating roller and the sunken section of the second counter-rotating folding roller;

wherein each of the two folding rollers further includes at least one first sucking channel provided at each of two lateral sides of each of the wedge-shaped protrusions, and at least one second sucking channel provided at each of the anvil recesses;

wherein the first and the second sucking channels may be controlled to suck or to stop sucking thereat, so that paper sheets separately transferred to the two folding rollers are orderly sucked to or released from the outer circumferential surface of the folding roller; and wherein when one of the anvil recesses on one of the two folding rollers is moved to the pre-compressing space, suction at the second sucking channel at the anvil recess is generated in order to produce a suction force, which cooperates with the action of the wedge-shaped protrusion fitted in that anvil recess to produce a folding line on the paper sheet bearing on the anvil recess.

2. The mechanism as claimed in claim 1, wherein the second compressing mechanisms having the same number as that of the first compressing mechanisms, and the second compressing mechanisms on the two folding rollers being separately located near and at the same side of each first compressing mechanism; and wherein the second compressing mechanisms on the two counter-rotating folding rollers are alternately moved to the pre-compressing space, whereby when one second compressing mechanism on one of the two folding rollers is moved to the pre-compressing space, one sunken section on the other folding roller is also moved to the pre-compressing space at the same time.

3. The mechanism as claimed in claim 2, wherein when one of the wedge-shaped protrusions at one of the two folding rollers is moved to the pre-compressing space, the wedge-shape protrusion is just fitted in one anvil recess on the other folding roller.

4. The mechanism as claimed in claim 3, wherein each of the two folding rollers is provided on the outer circumferential surfaces with a plurality of axially spaced annular grooves, whereby the first and second compressing mechanisms, the wedge-shaped protrusions, and the anvil recesses are divided by the annular grooves into a plurality of segments.

* * * * *